US008955582B2

(12) United States Patent
Wang et al.

(10) Patent No.: US 8,955,582 B2
(45) Date of Patent: Feb. 17, 2015

(54) BEAMLESS MECHANIC-REVERSING LONG STROKE PUMPING UNIT

(76) Inventors: Yi Wang, Panjin (CN); Zijiang Yang, San Ramon, CA (US); Jin Wang, Panjin (CN)

( * ) Notice: Subject to any disclaimer, the term of this patent is extended or adjusted under 35 U.S.C. 154(b) by 435 days.

(21) Appl. No.: 13/563,761

(22) Filed: Aug. 1, 2012

(65) Prior Publication Data

US 2013/0045116 A1 Feb. 21, 2013

(30) Foreign Application Priority Data

Aug. 16, 2011 (CN) ..... 2011 1 0234109

(51) Int. Cl.

| | |
|---|---|
| ***E21B 43/00*** | (2006.01) |
| ***F04B 17/03*** | (2006.01) |
| ***F04B 49/02*** | (2006.01) |
| ***F04B 47/02*** | (2006.01) |
| ***E21B 43/12*** | (2006.01) |

(52) U.S. Cl.

CPC ..... *F04B 47/02* (2013.01); *E21B 43/126* (2013.01)

USPC ..... 166/68.5; 166/68; 166/105; 166/369; 417/415; 417/217

(58) Field of Classification Search

USPC ..... 417/217, 415, 904; 166/68, 68.5, 105, 166/369

See application file for complete search history.

(56) References Cited

U.S. PATENT DOCUMENTS 1,970,596 A * 8/1934 Coberly ..... 74/89.22
2,683,424 A * 7/1954 Kane ..... 417/399
3,345,950 A * 10/1967 Bender ..... 318/14
3,483,828 A * 12/1969 Bender ..... 91/310
3,528,305 A * 9/1970 Rizzone et al. ..... 74/89.22
3,793,904 A * 2/1974 Grable ..... 74/590
4,062,640 A * 12/1977 Gault ..... 417/415
4,161,137 A * 7/1979 Gaddy ..... 92/13
4,197,766 A * 4/1980 James ..... 74/89.2
4,391,155 A * 7/1983 Bender ..... 74/89.2
4,404,863 A * 9/1983 James ..... 74/89.2
4,483,208 A * 11/1984 Parker, Jr. ..... 74/41
4,496,285 A * 1/1985 Albert et al. ..... 417/12
4,651,582 A * 3/1987 Bender ..... 74/89.22
4,719,811 A * 1/1988 Lang et al. ..... 74/89.22
4,761,120 A * 8/1988 Mayer et al. ..... 417/403
4,973,226 A * 11/1990 McKee ..... 417/18
5,018,350 A * 5/1991 Bender ..... 60/369
5,375,657 A * 12/1994 Shi et al. ..... 166/68.5
5,735,170 A * 4/1998 Bales et al. ..... 74/41
6,113,355 A * 9/2000 Hult et al. ..... 417/214

(Continued)

*Primary Examiner* — Alexander Comley

(74) *Attorney, Agent, or Firm* — Ash Tankha; Lipton, Weinberger & Husick

(57) ABSTRACT

A beamless mechanic-reversing long stroke pumping unit is provided for petroleum production in diverse types of oil fields. Its mechanic-reversing system consists of differentials, brakes, etc. With two differentials assembled together, taper gears inside them perform revolution and rotation, enabling the pumping unit to achieve direction change and speed change mechanically. The stroke length of the pumping unit can reach 8 meters or longer, and the adjustment process is more convenient than most, by merely tuning the position of the proximity switches. Abrasion of the chains typically caused due to resetting of a motor frequently during operation, is eliminated in this pumping unit. The pumping unit has more reliable operation performance, more convenient maintenance, lower costs, better energy saving effects, and can be applied in land oil fields, offshore oil fields, oil wells with low permeability, etc.

20 Claims, 7 Drawing Sheets

(56) References Cited

U.S. PATENT DOCUMENTS 6,152,231 A * 11/2000 Grenke ..... 166/369
6,460,622 B1 * 10/2002 Rice ..... 166/369
6,749,017 B1 * 6/2004 Lu et al. ..... 166/53
7,001,157 B2 * 2/2006 Xiaoxi ..... 417/415
2002/0007952 A1 * 1/2002 Vann ..... 166/369

* cited by examiner

BEAMLESS MECHANIC-REVERSING LONG STROKE PUMPING UNIT

CROSS REFERENCE TO RELATED APPLICATIONS

This application claims the benefit of non-provisional patent application number 201110234109.8 titled "A beamless mechanic-reversing long stroke pumping unit", filed on Aug. 16, 2011 in the State Intellectual Property Office of the People's Republic of China.

The specification of the above referenced patent application is incorporated herein by reference in its entirety.

FIELD OF THE INVENTION

This invention discloses a mechanical oil production equipment in an oil field, and more specifically a kind of drum type beamless long stroke pumping unit which is mechanic-reversing and assembled with travelling blocks.

BACKGROUND

Currently, there are two kinds of drum type beamless pumping units with good features: a chain pumping unit whose maximum stroke length may reach eight meters and which has a reasonable running curve and a desirable energy saving efficiency. However, this chain pumping unit is short in the bellows; the chains are distributed vertically and are too long to be lubricated. The abrasion of the chains results in a reversing stroke. The chains are difficult to repair and the maintenance cost is prohibitively high. In addition, the stroke length of the chain pumping unit cannot be adjusted. The other one is a drum type electric-reversing pumping unit which can reverse ten thousand times every day by adopting variable frequency devices or magnetic switches. The disadvantages of the drum type electric-reversing pumping unit are: starting the motor frequently results in high starting current and is less energy efficient. The transducer causes many negative effects during operation, such as network pollution of alternating current power, a harmonic code interference process, a short lifetime because of electrical element heating, etc. In addition, a control system such as a transducer is liable to be affected by working conditions and environmental factors; therefore the flexibility and reliability of the transducer are relatively low.

SUMMARY OF THE INVENTION

This invention provides a beamless mechanic-reversing long stroke pumping unit with a variety of advanced features as mentioned below: reasonable structure, reliable operation, convenient to repair, lower costs, energy saving, easy to adjust stroke length, etc. The beamless mechanic-reversing long stroke pumping unit thoroughly abandons the concept of chain-reversing and motor variable frequency drive (VFD) reversing. The beamless mechanic-reversing long stroke pumping unit addresses the problems of frequent motor resetting and chain abrasion.

The beamless mechanic-reversing long stroke pumping unit consists of a steel frame, a reversing reducer, a control system, a weight box, blocks, a drum, and chains.

The reversing reducer, which is the core technology of this invention, has two main functions: reversing and reducing speed. The reversing reducer is composed of two differentials, two reversing brake systems, taper gears, cylinder gears, an output drum, a reversing control system, and a concave box.

The two reducers, in commutation, operate as one assembly. Each reducer is made up of two sun gears, four planetary gears, one universal shaft, and a shell. There are many kinds of reducers, such as a cylindrical gear reducer, a taper gear reducer, an antiskid reducer, etc. Due to its simple and compact structure and outstanding work stability, the taper gear reducer is widely used and shall be the first choice. The reducer, with a hundred years' history, and which was invented by Louis Renault, the founder of French Renault, has proved to be a highly mature technology.

This invention installs cylindrical meshing gears on the shells of the two reducers. According to the design needs, one to three idle gears can be added in the middle of two gears and the number of idle gears will not affect the reversing and reducing. In operation, two differentials works alternately; when one of the differentials is active, the other one becomes idle and vice versa. The bevel gears of two alternate reducers run in rotation and revolution and change speed and direction, which accomplish a commutation process to achieve linear reciprocating motion of the pumping units.

In the middle of the sun gears (half shaft inserted side gear) of the two reducers, four joints of side gears are inserted; the forehead of each of the two joint side gears on the output side is installed with small bevel gears; these two small bevel gears are connected with related big bevel gears; the big bevel gears are fixed on an output shaft and are coaxial with an output roller.

The two side gears on the other side stretch out of the case. A reversing braking device is installed on each side gear. As long as the two alternating side gears are stopped, the reducers work alternately and the output shaft rotates forward and backward. The braking device can adopt a drum brake or a disc brake; the disc brake is adopted here. The disc brake is composed of a braking disc, a plunger hydraulic pump, a lever, and an electromagnet. The plunger hydraulic pump is installed on a concave box. The fulcrum of the lever is connected flexibly with an axle pin. The top end of the lever is fixed on the plunger while the bottom end is connected with an electromagnet. The powered electromagnet is absorbed to the rotating brake disc and drives the lever to rotate with the brake disc to a certain angle. The upper end of the lever pushes the plunger. The lever and the plunger hydraulic pump exert a positive pressure to a brake caliper to stop the brake disc and the semi-shaft. The plunger hydraulic pump mentioned above imitates a foot brake system; thus no external force is needed here. The self-rotation of the brake disc drives the electromagnet to push the plunger by the lever in order to brake itself through the hydraulic brake tong. Therefore, the pump does not need an electric oil pump or a cooling system. Consequently, the pump is free of the needs to repair an oil pump or replace hydraulic oil. The two differentials are designed to be able to idle simultaneously and under this situation, the semi-axles on the output side, the small taper gears, the big taper gears, and the drum remain motionless, thereby preventing an accident in case both groups of brakes fail. This outstanding characteristic makes the system safer, more reliable, and have a longer life span.

The reversing control system consists of proximity switches, an electromagnet, and a simple control circuit component. The control circuit adopts 12V-36V direct current (DC) that is used for controlling the working of two electromagnets alternately. An electromagnet having a power of 30 W-60 W is sufficient and its size is no more than that of a computer mouse. Two proximity switches are installed on the top end and the bottom end of the steel frame respectively. When working initially, the reversing reducer is idling, which means the output drum remains motionless while the two semi-axles and the two brake discs are rotating. (Note: the brake disc always rotates or stops in the same direction). When one of the two proximity switches is connected, the corresponding electromagnet generates electromagnetic fields for braking the semi-axle by absorbing to the brake discs. After that, a suspension point moves to the other proximity switch and repeats the above process. Due to a few seconds of latency after releasing the brakes, motion inertia and deformation of the suspension point are eliminated and hence a reversing process is completed by braking the other semi-axle. By repeating the above process, the reciprocating movement of the pumping unit is accomplished. Delay time of the two electromagnets working alternatively can be adjusted according to the permeability and consistency of oil.

Two sets of buffer suspension springs are installed inside the weight box. The springs suspend to release the shock when the weight box moves downwards. The energy stored in the suspension springs plays a supporting role for auxiliary reversing when the weight box moves upwards.

The chains of the invention are for drum use only. Each of the chains consists of a chain plate, an axle sleeve, an axle pin, and an oil nozzle. There are two axle pin holes on each section of the axle sleeve and each hole is inserted by an axle pin. The central hole of the axle pin is connected with an oil output hole on the circumference. An oil entrance hole is closed by an oil nozzle. Each axle sleeve is connected by chain plates. The axle sleeve and the chain plate should be arc-shaped and the radian of the two should conform to the output drum.

Several significant advantages of this mechanic-reversing system are:

1. The motor keeps rotating in one direction at a constant speed and the mechanic-reversing system takes care of the reversing process, which prevents the motor from rotating in different directions by use of an inverter, thereby resolving the problems caused by the inverter, such as the energy consumption of a large starting current during the frequent motor start-stop action. Besides, compared to the chain oil pump, this production has a shorter driving chain, an improved lubrication condition, and less possibility of being abraded.
2. The mechanic-reversing system consists of two differential gears. The mechanic-reversing system adopts an axle drive, a hydraulic brake, and has a delay-buffer function, which minimize the impact of the reversing process and makes the system more reliable and stable.
3. Stroke adjustment can be achieved easily by moving the positions of the proximity switches.
4. The parts adopted in this system include differentials, brakes, bevel gears, axles, etc., which are industrial standardized automobile parts with good quality and low price.
5. Easy maintenance, less failure, light weight, easy to install and transport.
6. A flexible piece adopts a plate chain, which has a longer life than a steel wire rope and has less wind resistance than a wide belt.

BRIEF DESCRIPTION OF THE DRAWINGS

Here is a further demonstration of the invention combined with drawings and executions.

DETAILED DESCRIPTION OF THE INVENTION

Figure 1:
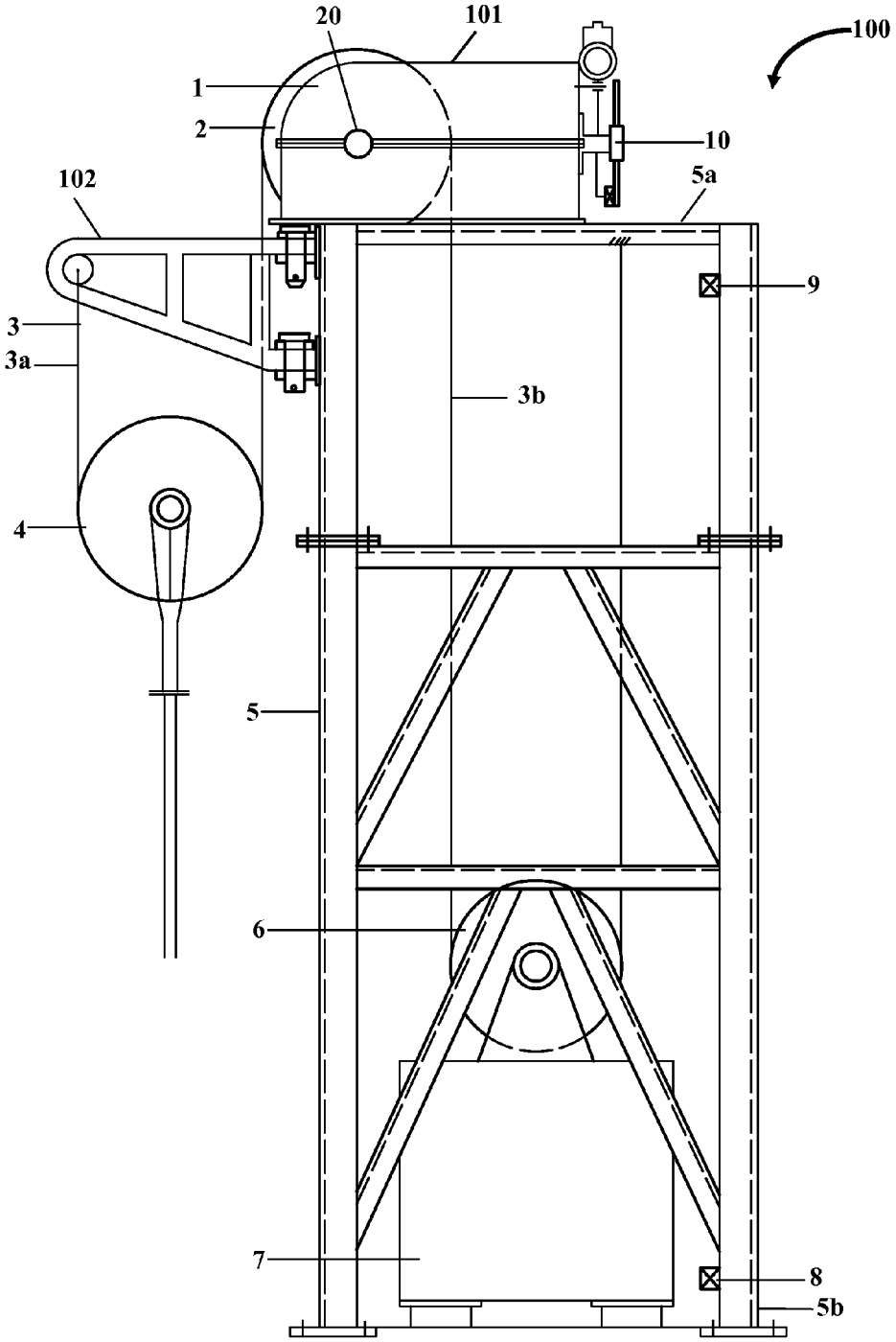
FIG. 1 illustrates a pumping unit.

FIG. 1 illustrates a pumping unit 100. A reversing reducer 1 is set on the top of a steel frame 5. A chain 3 passes by a drum 2. The left side chain 3*a* passes by a block 4 and connects with a small bracket 102 assembled on the steel frame 5. The right side chain 3*b* passes by a block 6 in a weight box 7 and connects with the top end 5*a* of the steel frame 5. Proximity switches 8 and 9 are set on the bottom end 5*b* and the top end 5*a* of the steel frame 5 respectively.

Figure 2:
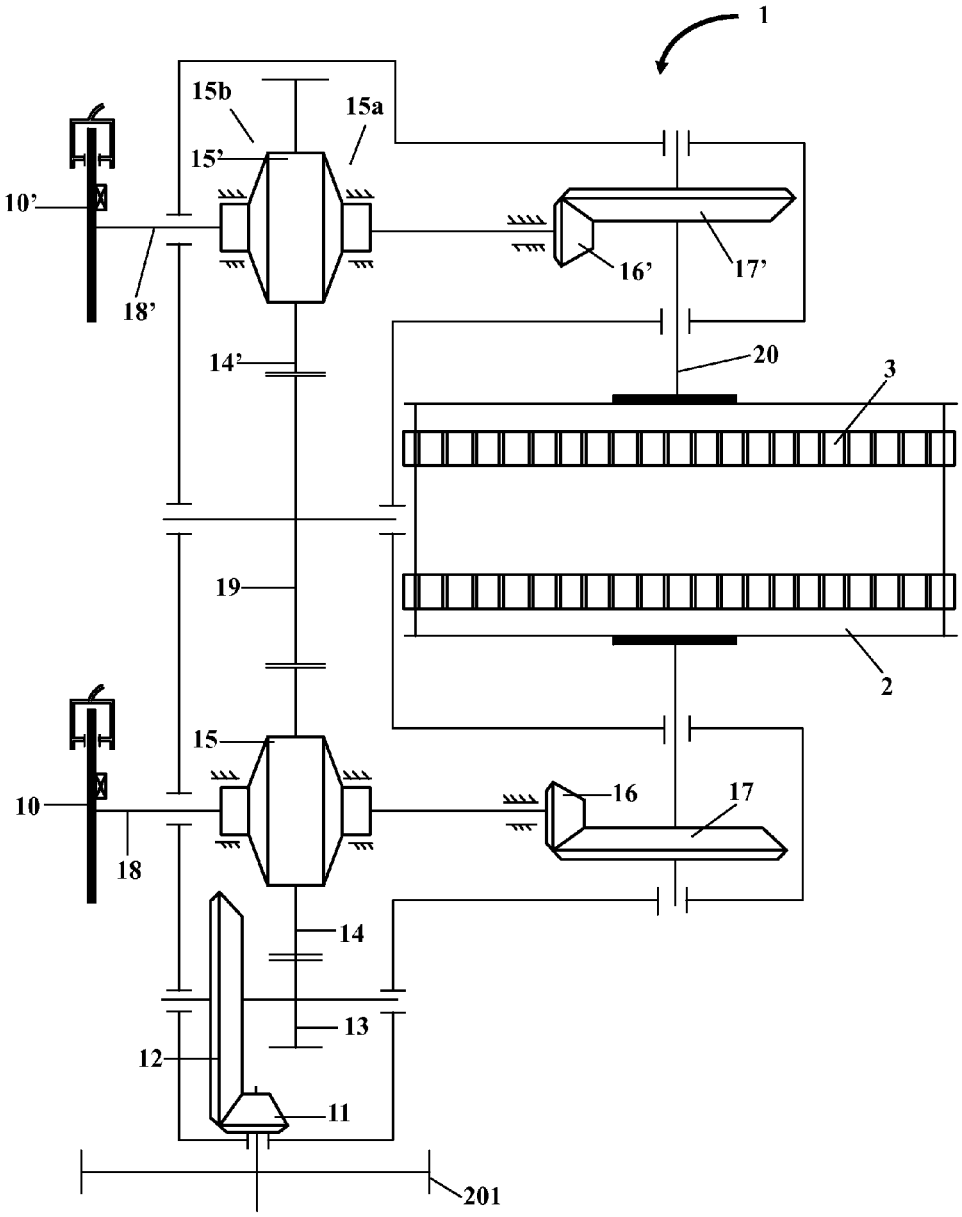
FIG. 2 illustrates a reversing reducer.

FIG. 2 illustrates a reversing reducer 1. The reversing reducer 1 is a symmetry structure. A motor transmits a torque to a taper gear 11 by belt wheels 201. The torque is then transmitted to an outer gear 14 of a differential 15 after reducing speed by a gear 12 and a gear 13. The gear 14' is driven to rotate through an idle gear 19 by the gear 14. The differentials 15 and 15' are driven to rotate simultaneously by the gear 14 and the gear 14' respectively. Semi-axles 16 and 16' are inserted into the right side 15*a* of the differentials 15 and 15' respectively. Small taper gears 16 and 16' intermesh with paired large taper gears 17 and 17' respectively that are coaxial with an output drum 2. The other two semi-axles 18 and 18' are inserted into sun wheels which are on the left side 15*b* of the differentials 15 and 15' respectively. Reversing brake systems 10 and 10' are installed on the semi-axles 18 and 18' respectively.

Figure 3:
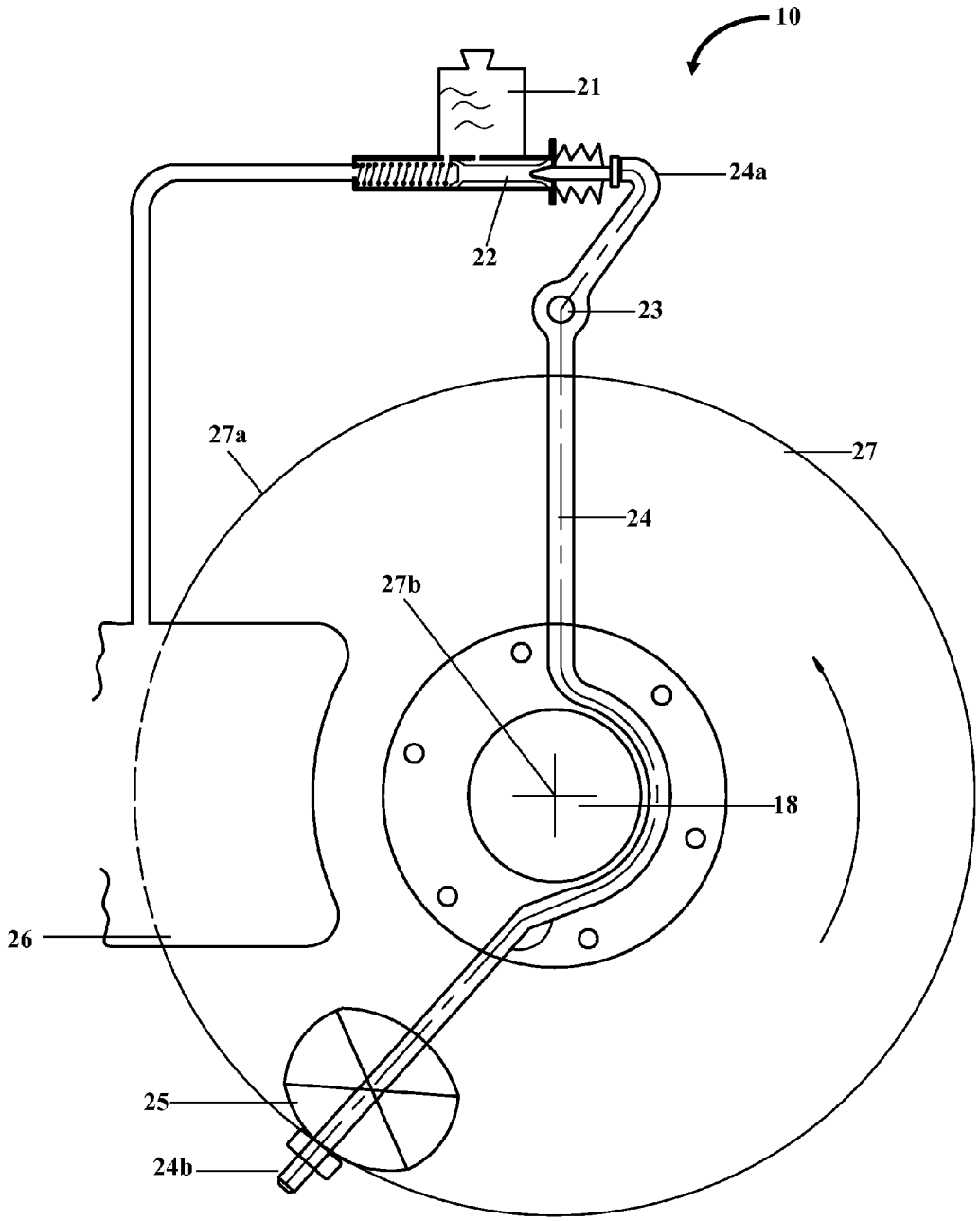
FIG. 3 illustrates a reversing brake system.

FIG. 3 illustrates a reversing brake system 10. A plunger hydraulic pump 21 is installed on a box 101 of the reversing reducer 1 shown in FIG. 1. A lever 24 is articulated with an axle pin 23. The top end 24*a* of the lever 24 is connected with a plunger 22. The bottom end 24*b* of the lever 24 is configured with electromagnets 25. A brake tong 26 is located on the central line of the left side 27*a* of the brake disc 27. Both the above mentioned central line and the horizontal line passing through the center 27*b* of the brake disc 27 are aligned with the central line of the concave box 101.

Figure 5:
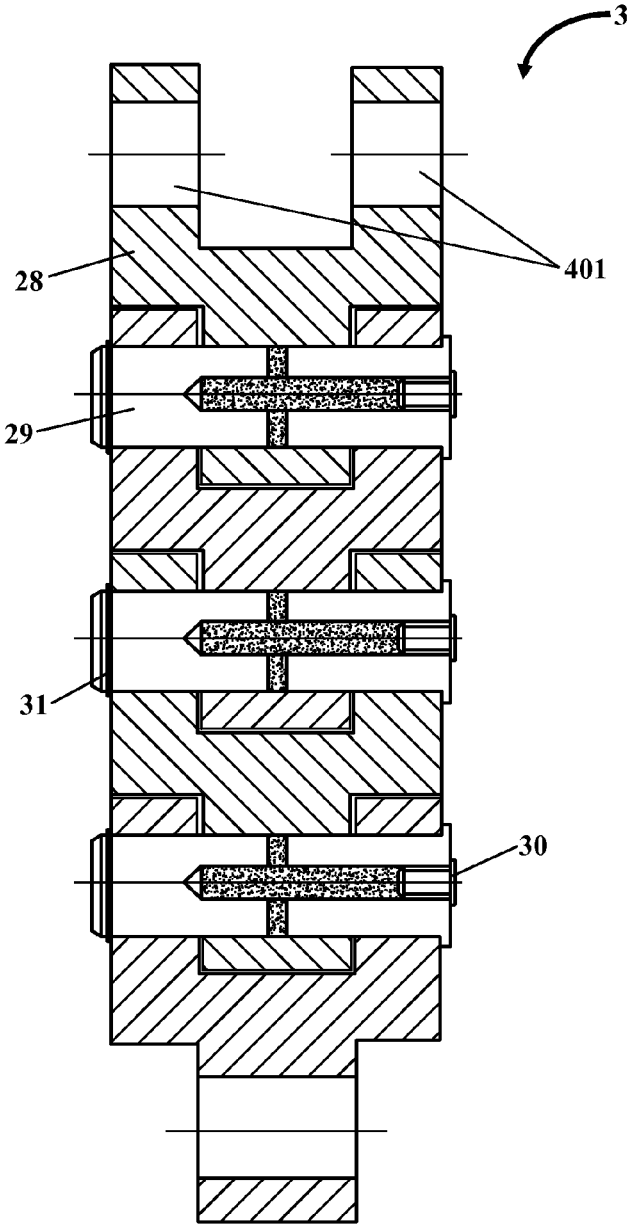
FIG. 5 illustrates the sectional view of the chains.
Figure 4:
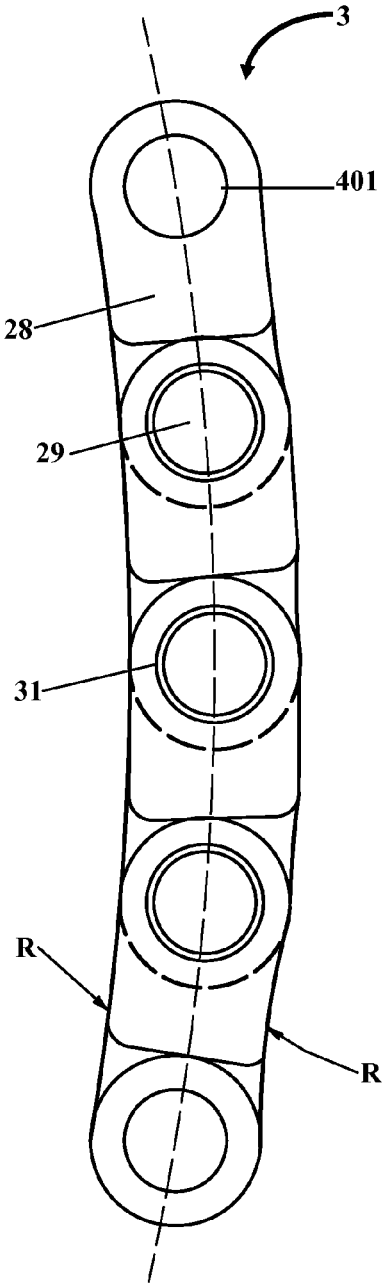
FIG. 4 illustrates the main view of chains.

FIG. 4 and FIG. 5 illustrate four sections of a chain 3. Axle sleeves 28, a chain plate 29, and an axle pin 30 are assembled on each section of the chain 3. There are two axle holes 401 on the axle sleeves 28 in each section of the chain 3. An axle pin 30 is inserted into each of the holes 401. There are oil passages, which are connected with an inner hole of the axle pin 30, on the circumference of the axle pin 30. An oil input entrance of the axle pin 30 is closed by an oil nozzle. The axle pin 30 is articulated with the axle sleeves 28. The two sides of the axle pin 30 are connected by two chain plates 29 respectively. The chain plate 29 is fixed by the axle pin 30.

Figure 7:
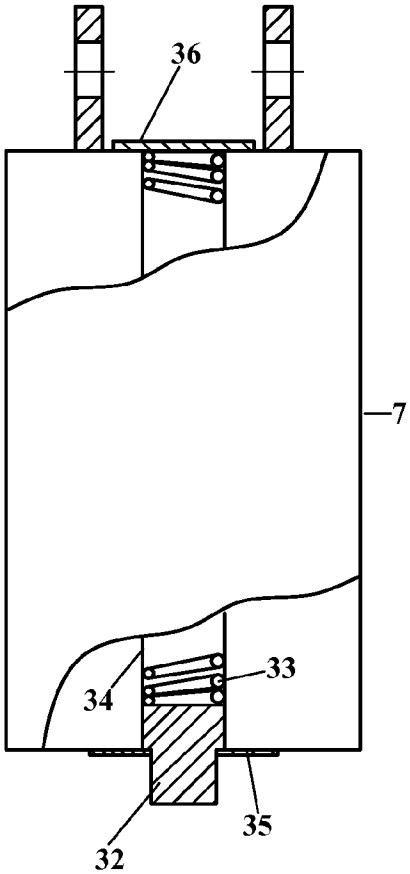
FIG. 7 illustrates the side view of the weight box.
Figure 6:
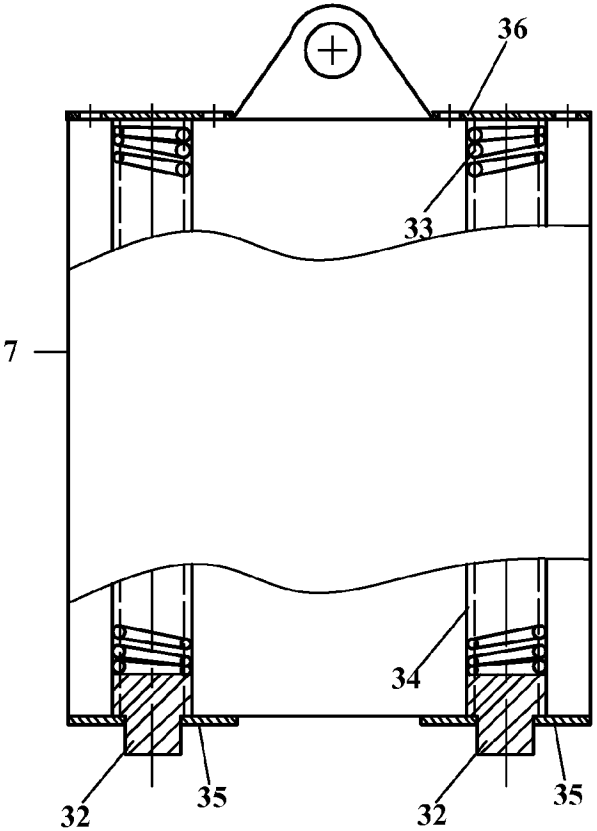
FIG. 6 illustrates the main view of a weight box.

FIG. 6 and FIG. 7 illustrate the structure of a weight box 7. As shown in FIG. 7, the two sets of inner springs 33 are installed inside a steel tube 34, below which a bracket 32 is installed. The bracket 32 slides away from the bottom end cover 35 to the steel tube 34. The upper end cover is a blank cap 36.

Figure 8:
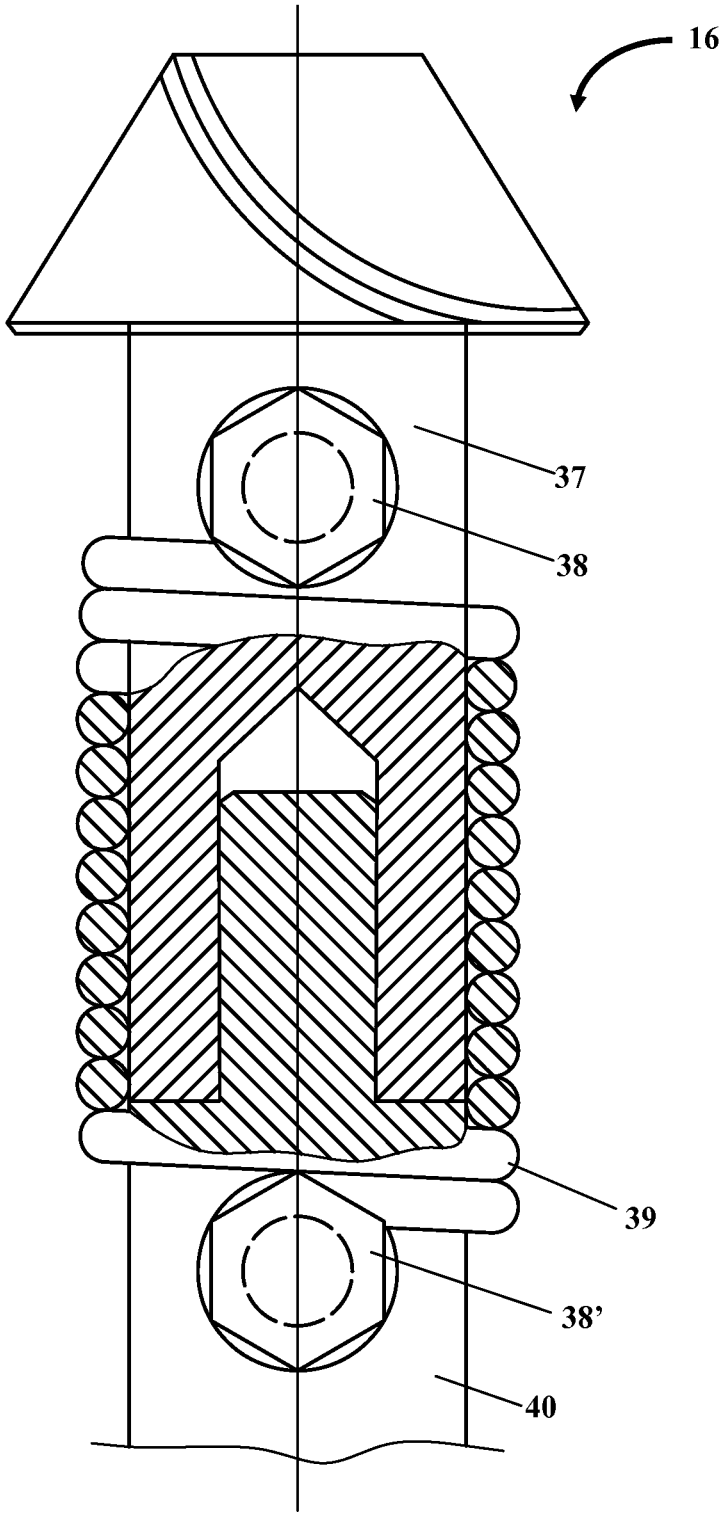
FIG. 8 illustrates a split semi-axle.

FIG. 8 illustrates the structure of a semi-axle 16, in which the semi-axle 16 is split into an upper half 37 and a lower half 40. The upper half 37 and the lower half 40 are connected to each other by a movable junction installed in a torsion spring 39. Bolts 38 and 38' are used on the top and bottom of the torsion spring 39 to fix the torsion spring 39.

Figure 9:
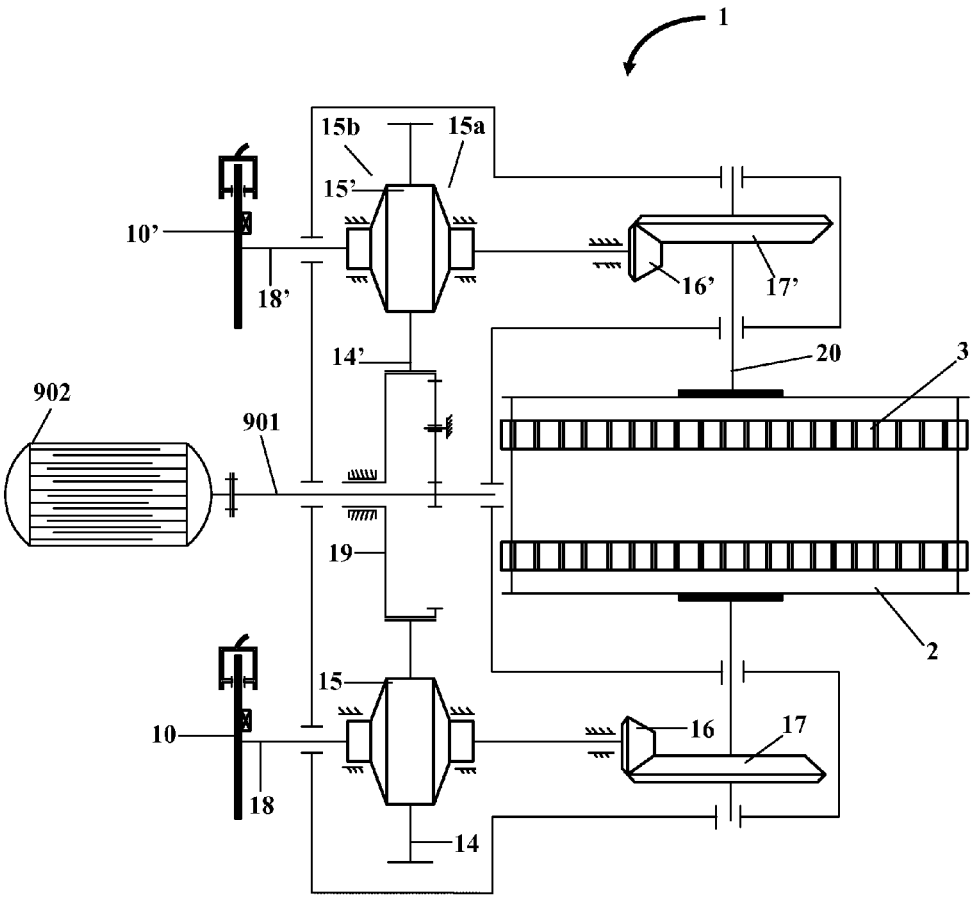
FIG. 9 illustrates another possible structure of the reversing reducer.

FIG. 9 illustrates another possible structure of the reversing reducer 1, in which the belt wheels 201 shown in FIG. 2 and the input taper gears are eliminated, and in which an idle gear 19 works as the active gear. The idle gear 19 of the reversing reducer 1 is constructed as a planetary reducer whose input axle 901 extends outside the box 101 and connects to a motor 902 directly. A variety of structures, for instance, NGW, 2K-H and 3K, are available for the planetary reducer mentioned here, all of which can meet the demands of this design.

The invention is not limited to performing only in a way or in a field as described in the detailed descriptions of FIGS. 1-9. As long as the two differentials 15 and 15' are combined together and the direction of the output shaft 20 shown in FIG. 2 is changed by braking alternately, the pumping unit 100 shown in FIG. 1 operates even if there is a change in the structure, method, or the field. This invention is not only used in land oil production, but is also used in offshore oil production. In addition, the pumping unit 100 fits in oil wells with low permeability.

The invention claimed is:

1. A beamless mechanic-reversing long stroke pumping unit, comprising:

a reversing reducer comprising:

a set of differentials, each of said differentials engageably connected to an outer gear;

a set of semi-axles, a first of said semi-axles connected to a first end of said each of said differentials, and a second of said semi-axles extending outwardly from said reversing reducer and connected to a reversing brake system; and a set of taper gears, a first of said taper gears configured on a front end of said first of said semi-axles and intermeshed with a second of said taper gears, said second of said taper gears coaxially connected to a drum of said beamless mechanic-reversing long stroke pumping unit, wherein said second of said taper gears is configured to receive a torque transmitted from a motor by one of said differentials via said first of said semi-axles for rotating said drum; and said reversing brake system operably connected to said reversing reducer, said reversing brake system comprising:

a brake disc coaxially and rigidly coupled to said second of said semi-axles of said reversing reducer;

a lever slidably connected to said second of said semi-axles of said reversing reducer;

an electromagnet operably connected to a first end of said lever and an edge of said brake disc, said electromagnet configured to drive said lever on rotation of said brake disc for activating a plunger hydraulic pump;

said plunger hydraulic pump operably connected to a second end of said lever, said plunger hydraulic pump configured to brake rotation of said one of said differentials of said reversing reducer by said driving of said lever caused by said electromagnet; and a brake tong operably connected to said plunger hydraulic pump, wherein said brake tong is configured to brake said rotation of said brake disc on activation of said plunger hydraulic pump;

whereby said rotation of said drum by alternate rotation of each of said differentials of said beamless mechanic-reversing long stroke pumping unit enables extraction of oil in an oil field.

2. The beamless mechanic-reversing long stroke pumping unit of claim 1, wherein said reversing reducer further comprises an idle gear configured to intermesh one of said differentials with another of said differentials.

3. The beamless mechanic-reversing long stroke pumping unit of claim 2, wherein said idle gear of said reversing reducer is configured as a planetary reducer directly connected to said motor.

4. The beamless mechanic-reversing long stroke pumping unit of claim 1, further comprising a frame configured to mount said reversing reducer and said reversing brake system.

5. The beamless mechanic-reversing long stroke pumping unit of claim 4, wherein said reversing reducer is rigidly connected to an upper end of said frame.

6. The beamless mechanic-reversing long stroke pumping unit of claim 4, further comprising a concave box rigidly attached at an upper end of said frame, wherein said concave box is configured to contain said reversing reducer.

7. The beamless mechanic-reversing long stroke pumping unit of claim 1, wherein said each of said differentials comprises:

a set of opposing sun gears, wherein one of said opposing sun gears is coaxially connected to said first of said semi-axles and configured to transmit said torque to said first of said semi-axles, and wherein another one of said opposing sun gears is coaxially connected to said second of said semi-axles and configured to brake said rotation of said one of said differentials via said reversing brake system; and a plurality of planetary gears, in engageable communication with said opposing sun gears, wherein said planetary gears of said one of said differentials are configured to rotate and revolve between said opposing sun gears and to transmit said torque to another one of said differentials via an idle gear on said braking of said one of said differentials.

8. The beamless mechanic-reversing long stroke pumping unit of claim 1, further comprising a set of chains rigidly suspended from a frame of said beamless mechanic-reversing long stroke pumping unit, wherein said chains are configured to rollably support a set of travelling blocks within said beamless mechanic-reversing long stroke pumping unit, and wherein said chains are configured to be rollably driven along a circumference of said drum for raising one of said travelling blocks and lowering another one of said travelling blocks.

9. The beamless mechanic-reversing long stroke pumping unit of claim 8, further comprising a weight box suspended from said another one of said travelling blocks, wherein said weight box is configured to be raised and lowered by said chains configured to rollably support said another one of said travelling blocks.

10. The beamless mechanic-reversing long stroke pumping unit of claim 9, further comprising buffer suspension springs positioned within said weight box, wherein said buffer suspension springs are configured to absorb a shock created during landing of said weight box, store energy obtained from said shock, and release said stored energy during said raising of said weight box.

11. The beamless mechanic-reversing long stroke pumping unit of claim 10, wherein each of said buffer suspension springs is contained in an elongate tube disposed within said weight box, wherein an upper end of said elongate tube is covered by a blank cap, and wherein a lower end of said elongate tube is covered by a bracket installed on a lower end of each of said buffer suspension springs, wherein said bracket extends outwardly from a bottom end of said weight box for supporting said weight box.

12. The beamless mechanic-reversing long stroke pumping unit of claim 8, wherein each of said chains comprises a plurality of chain plates connected by axle pins, wherein each of said chain plates comprises axle holes for receiving axle pins that connect said chain plates to each other.

13. The beamless mechanic-reversing long stroke pumping unit of claim 12, wherein one end of each of said axle pins is configured as an oil inlet for receiving said oil and sealed with an oil nozzle, wherein said oil inlet leads to an oil outlet disposed in a middle section of said each of said axle pins.

14. The beamless mechanic-reversing long stroke pumping unit of claim 1, wherein said reversing reducer further comprises an output shaft configured to coaxially connect said second of said taper gears to said drum.

15. The beamless mechanic-reversing long stroke pumping unit of claim 1, further comprising an axle pin inserted into a fulcrum of said lever of said reversing brake system for flexibly pushing a plunger into said plunger hydraulic pump, wherein said plunger hydraulic pump is configured to exert a positive pressure on said brake tong on receiving said push of said plunger to brake said rotation of said brake disc.

16. The beamless mechanic-reversing long stroke pumping unit of claim 1, wherein said brake tong is aligned at a central line of a concave box that contains said reversing reducer, wherein said central line coincides with a horizontal line that passes through a center of said brake disc.

17. The beamless mechanic-reversing long stroke pumping unit of claim 1, wherein each of said semi-axles comprises a first section and a second section connected via a torsion spring positioned therebetween.

18. A method for beamless mechanic-reversing long stroke pumping of oil from an oil well, comprising:

positioning a beamless mechanic-reversing long stroke pumping unit proximal to said oil well, said beamless mechanic-reversing long stroke pumping unit comprising:

a reversing reducer comprising:

a set of differentials, each of said differentials engageably connected to an outer gear, wherein one of said differentials is intermeshed with another of said differentials via an idle gear;

a set of semi-axles, a first of said semi-axles connected to a first end of said each of said differentials, and a second of said semi-axles extending outwardly from said reversing reducer and connected to a reversing brake system; and a set of taper gears, a first of said taper gears configured on a front end of said first of said semi-axles and intermeshed with a second of said taper gears, said second of said taper gears coaxially connected to a drum of said beamless mechanic-reversing long stroke pumping unit;

said reversing brake system operably connected to said reversing reducer;

a set of chains rigidly suspended from a frame of said beamless mechanic-reversing long stroke pumping unit, said chains configured to rollably support a set of travelling blocks within said beamless mechanic-reversing long stroke pumping unit; and a weight box suspended from one of said travelling blocks;

transmitting a torque produced by a motor operably coupled to said beamless mechanic-reversing long stroke pumping unit, to one of said differentials of said reversing reducer;

transmitting said torque by said one of said differentials to said second of said taper gears of said reversing reducer via said first of said semi-axles for rotating said drum of said beamless mechanic-reversing long stroke pumping unit in a first direction, wherein said rotation of said drum in said first direction rollably drives said chains along a circumference of said drum for raising one of said travelling blocks and lowering another one of said travelling blocks; and alternately raising and lowering said weight box by said driving of said chains in opposing directions based on braking of said rotation of said one of said differentials of said reversing reducer by said reversing brake system for enabling pumping of said oil from said oil well, wherein said reversing brake system performs said braking of said rotation of said one of said differentials of said reversing reducer to cause said another of said differentials to receive said torque from said motor via said idle gear to rotate said drum in a second direction that opposes said first direction, via said first of said semi-axles and said second of said taper gears.

19. The method of claim 18, wherein said reversing brake system comprises:

a brake disc coaxially and rigidly coupled to said second of said semi-axles of said reversing reducer;

a lever slidably connected to said second of said semi-axles of said reversing reducer;

an electromagnet operably connected to a first end of said lever and an edge of said brake disc, said electromagnet configured to drive said lever on rotation of said brake disc for activating a plunger hydraulic pump;

said plunger hydraulic pump operably connected to a second end of said lever; and a brake tong operably connected to said plunger hydraulic pump.

20. The method of claim 19, wherein said braking of said rotation of said one of said differentials of said reversing reducer by said reversing brake system comprises:

activating said plunger hydraulic pump by driving said lever, on rotation of said brake disc caused by said transmission of said torque through said one of said differentials, via said second of said semi-axles; and braking said rotation of said brake disc by said brake tong on said activation of said plunger hydraulic pump.

* * * * *